United States Patent [19]

Bakker

[11] Patent Number: 4,827,613

[45] Date of Patent: May 9, 1989

[54] SHAVING APPARATUS

[75] Inventor: Eppe Bakker, Drachten, Netherlands

[73] Assignee: U.S. Philips Corp., New York, N.Y.

[21] Appl. No.: 158,444

[22] Filed: Feb. 22, 1988

[30] Foreign Application Priority Data

Mar. 4, 1987 [NL] Netherlands ..... 8700515

[51] Int. Cl.[4] ..... B26D 17/14

[52] U.S. Cl. ..... 30/43.6; 30/346.51

[58] Field of Search ..... 30/43.4, 43.5, 43.6, 30/43, 346.31

[56] References Cited

U.S. PATENT DOCUMENTS 2,289,323 7/1942 Dettle ..... 30/43.6
2,669,776 2/1952 Bebkolsicz ..... 30/43.6
3,001,281 9/1961 Mahon ..... 30/43.6 X
4,707,915 11/1987 Bakker et al. ..... 30/43.6

*Primary Examiner*—Douglas D. Watts
*Attorney, Agent, or Firm*—Ernestine C. Bartlett

[57] ABSTRACT

A shaving apparatus comprising a housing, a cutting plate and a cutting member which can be driven so as to be rotatable with respect to the cutting plate, said cutting member comprising a holder with cutting elements, said cutting elements comprising cutting sides at the radial ends. The holder comprises a bearing member in which the cutting elements are journalled so as to be rotatable as well as the positioning member for the cutting elements, the bearing member and the positioning member being rotatable with respect to each other and being coupled together by means of a resilient element.

3 Claims, 2 Drawing Sheets

SHAVING APPARATUS

FIELD OF THE INVENTION

The invention relates to a shaving apparatus comprising a housing, a cutting plate and a cutting member which can be driven so as to be rotatable with respect to the cutting plate, the cutting member comprising a holder with cutting elements, the cutting elements comprising cutting sides at the radial ends.

BACKGROUND OF THE INVENTION

Such a shaving apparatus is known, for example, from U.S. Pat. No. 3,710,442 issued Jan. 16, 1973. In this apparatus the cutting elements which are not in contact with the cutting plate are slightly moved outwards by the centrifugal force. This means that at the instant a cutting element during a revolution of the cutting member comes in contact with the cutting plate, rather large forces will occur to move the cutting element inwardly again in a very short period of time to a position as corresponds to the inside of the cutting plate. This will in general cause undesired vibrations in the apparatus, which moreover may lead to damage to the cutting member, the cutting plate and the other parts of the apparatus.

SUMMARY OF THE INVENTION

It is the object of the invention to mitigate the above mentioned disadvantage and the invention is characterized in that the holder comprises a bearing member in which the cutting elements are journalled so as to be rotatable, as well as a positioning member for the cutting elements, the bearing member and the positioning member being rotatable with respect to each other and being coupled together by means of a resilient element.

In especially preferred embodiments, the positioning member is constructed as a cylindrical member within which the bearing member is situated and which cylindrical member comprises slots for the cutting elements. Preferably, the relative movement of the bearing member and positioning member is restricted by abutments.

BRIEF DESCRIPTON OF THE DRAWINGS

The invention will now be described in greater detail with reference to a description of an embodiment shown in the Figures.

DETAILED DESCRIPTION OF THE PREFERRED EMBODIMENTS

Figure 1:
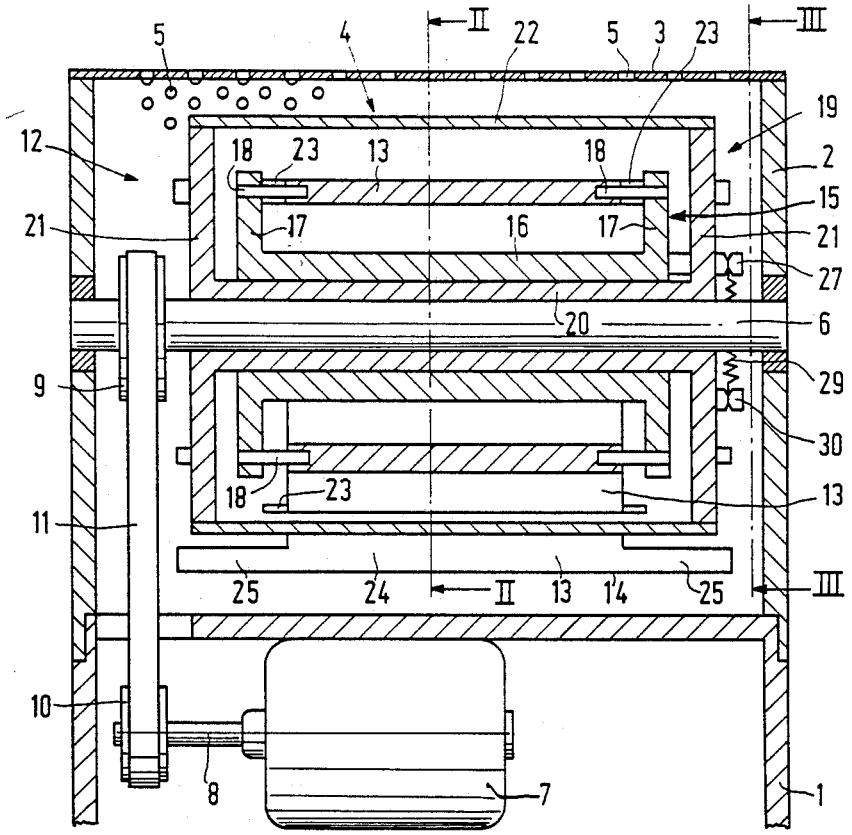
FIG. 1 is a diagrammatic longitudinal sectional view of a shaving apparatus according to the invention.

The shaving apparatus shown in the Figures comprises a housing 1 having a shaving head which comprises the flexible cutting plate 3 and a cutting member 4 which can be driven so as to be rotatable with respect to the cutting plate. The cutting plate 3 comprises a hair entrance aperture 5. The cutting member 4 comprises the shaft 6 which is journalled rotatably in the shaving head 2. The shaft 6 can be driven by the electric motor 7. For this purpose, pulleys 9 and 10, respectively, are provided on the shaft 6 and on the shaft 8 of the electric motor 7, and are coupled by means of the belts 11. In this manner the cutting member 4 can be driven so as to rotate with respect to the cutting plate 3, for example, in a direction denoted by arrow P.

The cutting member 4 further comprises a holder 12 and cutting elements 13 having cutting sides 14 at the radial ends of the cutting elements. The holder 12 comprises a bearing member 15 which consists of a sleeve 16 with flanged edges 17. The cutting elements 13 are journalled so as to be rotatable in the bearing member 15 by means of the shaft ends 18. The holder 12 also comprises a positioning member 19 which consists of the hub 20, the flanged edges 21 and a plate 22 which is bent according to a closed cylindrical surface. The bearing member 15 is present between the flanged edges 21 and is journalled so as to be rotatable on the hub 20 by means of the sleeve 16. The cutting elements 13 project through slots 23 in the curved plate 22. The ends 24 of the cutting elements projecting beyond the plate are widened on each side by portions 25 so that a larger part of the cutting plate is covered.

The cutting elements 13 are directed according to tangents at a circle 26 through the shaft ends 18. A flanged edge 17 comprises a pin 27 which projects through a slot 28 in the oppositely located flanged edge 21. By means of resilient element 29 the pin 27 is connected to the pin 30 in the flanged edge 21.

Figure 2:
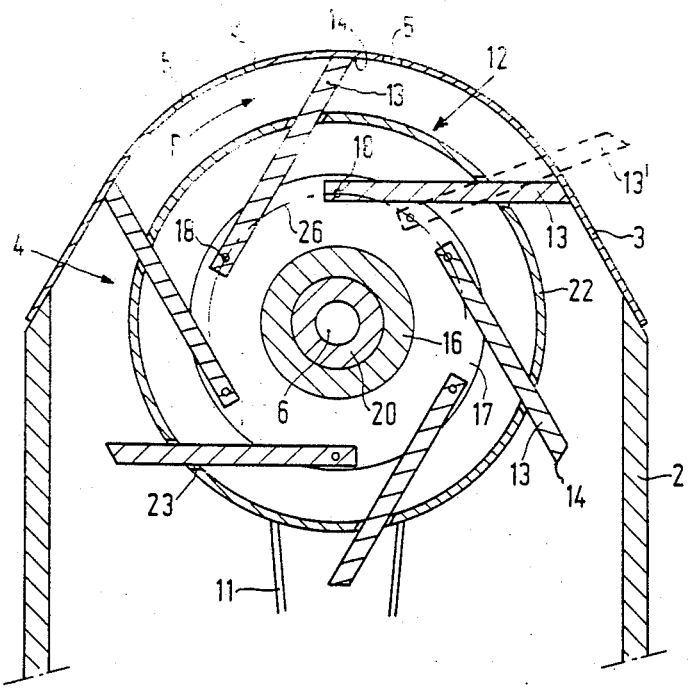
FIG. 2 is a sectional view taken on the line II—II in FIG. 1.
Figure 3:
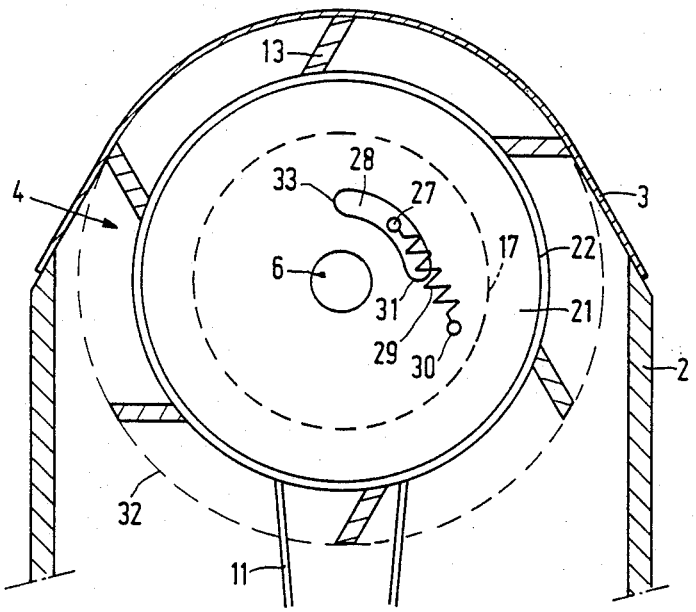
FIG. 3 is a sectional view taken on the line III—III in FIG. 1.

If the cutting plate 3 were not present, the resilient element 29 would draw the pin 27 against the wall part 31 of the slot 28 and the cutting element 13 would assume a position with respect to the support 12 as shown for a single cutting element 13' with broken lines in FIG. 2. In the presence of the cutting plate 3, however, the bearing member 15 is held in a slightly turned position with respect to the positioning member 19 by the forces exerted by said cutting plate on the cutting elements, as is shown in FIGS. 3 and 4. The pin 27 is free from wall parts 31 of slot 28. The resilient element 29 is constructed as a draw spring and in the position shown is tensioned so that a part of the cutting elements 13 engage the inside of the cutting plate with a pressure force which can be derived from said resilient element. However, as a result of the positioning element 29 the cutting elements 13 which are not in contact with the cutting plate 3 are also held in a position in which the ends (FIG. 3) are situated on a circle 32 which theoretically coincides with the inside of the cutting plate 3. In this manner impact phenomena at the instant a cutting element touches a cutting plate are avoided.

The hub 20 is rigidly connected to the shaft 6. The rotating movement is transferred from the positioning member 19 to the bearing member 15 by means of the resilient element 29. This resilient element 29 thus forms also a shock absorbing member which smoothes, for example, suddenly occurring forces on the cutting element 13.

Detrition of the ends of the cutting elements 13 is automatically compensated for by a relative rotation of the bearing member 15 with respect to the positioning member 19 under the influence of the resilient element 29.

The wall part 31 forms an abutment which restricts the rotation of the bearing member 15 with respect to positioning member 19 in the direction of the arrow P. The wall part 32 at the other end of the slot 28 forms an abutment which restricts the rotation in the opposite direction.

What is claimed is:

1. A shaving apparatus comprising a housing, a cutting plate and a cutting member which can be driven so as to be rotatable with respect to the cutting plate, said cutting member comprising a holder with cutting elements, the cutting elements comprising cutting sides at the radial ends, and the holder comprises a bearing member in which the cutting elements are journalled so as to be rotatable, as well as a positioning member for the cutting elements, the bearing member and positioning member being rotatable with respect to each other and being coupled together by means of a resilient element.

2. A shaving apparatus as claimed in claim 1, wherein the positioning member is constructed as a cylindrical member within which the bearing member is situated and which cylindrical member comprises slots for the cutting elements.

3. A shaving apparatus as claimed in claim 1 or 2, wherein the relative movement of bearing member and positioning member is restricted by abutments.

* * * * *